US008220780B2

(12) United States Patent
Guillore et al.

(10) Patent No.: US 8,220,780 B2
(45) Date of Patent: Jul. 17, 2012

(54) ASSEMBLY FOR SETTING, REMOVING AND MAINTAINING DOORS

(75) Inventors: Jean-Noel Guillore, Riec sur Belon (FR); Paul Janin, Cran-Gevrier (FR)

(73) Assignee: Jean-Noel Guillore, Riec Sur Belon (FR)

( * ) Notice: Subject to any disclaimer, the term of this patent is extended or adjusted under 35 U.S.C. 154(b) by 372 days.

(21) Appl. No.: 12/691,875

(22) Filed: Jan. 22, 2010

(65) Prior Publication Data

US 2010/0171084 A1 Jul. 8, 2010

Related U.S. Application Data

(63) Continuation-in-part of application No. 11/629,331, filed as application No. PCT/FR2005/001481 on Jun. 15, 2005, now abandoned.

(51) Int. Cl.
*B66F 11/00* (2006.01)

(52) U.S. Cl. ..... 254/131; 254/120

(58) Field of Classification Search ..... 254/121, 254/131, 120, 8 R, 21, 25
See application file for complete search history.

(56) References Cited

U.S. PATENT DOCUMENTS

| | | | | |
|---|---|---|---|---|
| 5,678,804 | A * | 10/1997 | Lintelman et al. | 254/131 |
| 5,749,113 | A * | 5/1998 | Witter | 7/166 |
| 6,497,399 | B1 * | 12/2002 | Nelson | 254/131 |
| 6,678,909 | B1 * | 1/2004 | Pyatt | 7/158 |
| 8,128,066 | B2 * | 3/2012 | Durrant | 254/131 |
| 2008/0237557 | A1 * | 10/2008 | Durrant | 254/131 |
| 2010/0171084 | A1 * | 7/2010 | Guillore et al. | 254/120 |

* cited by examiner

*Primary Examiner* — Lee D Wilson
(74) *Attorney, Agent, or Firm* — Defillo & Associates, Inc.; Evelyn A. Defillo

(57) ABSTRACT

The present invention relates to an assembly having in combination an apparatus and a smooth and rigid plane on which the apparatus moves. The assembly allows, when activated by the foot of the user acting as a drive and directive force, the door to be raised and movements from bottom to top, front to back, right to left and vice versa to be executed, while the hands of the user no longer carry the load and are free to intervene.

9 Claims, 4 Drawing Sheets

ASSEMBLY FOR SETTING, REMOVING AND MAINTAINING DOORS

CROSS REFERENCE TO RELATED APPLICATION

This application is a Continuation-In-Part of U.S. patent application Ser. No. 11/629,331 filed Dec. 11, 2006, now abandoned entitled "APPARATUS FOR SETTING, REMOVING AND MAINTAINING DOORS", pending, the entire disclosure of which is incorporated herein by reference, which is a National Phase of PCT/FR2005/001481 filed Jun. 15, 2005, claiming priority over French Application No. FR 0406547 filed Jun. 17, 2004, French Application No. 0407788 filed Jul. 13, 2004, and French Application No. 0503788 filed Apr. 15, 2005.

FIELD OF THE INVENTION

The present invention is from the field of precise handling gear and the invention particularly relates to an apparatus intended to facilitate the setting, removing and maintaining of objects such as, but not exclusive to, swinging doors.

It is known that the placing and positioning of heavy, bulky and thin objects, such as hinge doors, sliding doors and windows, as non-exclusive examples, necessitate precise adjustments since the male and female parts must be moved together before the parts can be joined coaxially. Currently, this operation is carried out manually. The door is raised and then positioned by successive approaches. This operation is difficult since the user, while he carries the load, must align the hinges coaxially. This leads to fatigue, loss of time, and numerous attempts that are often unproductive.

BACKGROUND OF THE INVENTION

The known systems are levers of the type comprising a rigid bar pivoting around a support axis situated between the drive force and the resistance. These are summary systems that are not satisfactory from a practical point of view.

SUMMARY OF THE INVENTION

The assembly according to the invention allows, by means activated by the foot of the user acting as a drive and directive force, the door to be raised and movements from bottom to top, front to back, right to left and vice versa to be executed, while the hands of the user no longer carry the load and are free to intervene.

The assembly according to the invention comprises, in combination, an apparatus and a smooth and rigid plane on which the apparatus moves;

the apparatus comprises a lever and a supporting element for supporting the lever; said lever is comprised of a first section and a second section coaxially connected, the first section extending on one side of the supporting element and the second section extending on the other side of the supporting element, said first section being shorter than said second section; the end of said first section not connected to the second section is equipped with a grip handle having a flat portion capable of sliding under the door to maneuver; said second section is equipped with a pivoting roller at its end not connected to said first section and with a receiving part capable of receiving a foot of a user; said supporting element comprises a body forming a fulcrum for the lever and, on its bottom portion, bearing rigid balls on each side of the lever, capable to roll with respect to said body and on said smooth and rigid plane;

the smooth and rigid plane comprises a flat main surface and side walls forming stops capable to keep the supporting element on said flat main surface;

said lever being capable to be activated by a foot of a user to an equilibrium position where said pivoting roller bears on said smooth and rigid plane or on a floor on which this plane rests; in this position, the assembly acts as a drive and directive force for raising the door, displacing the door on said smooth and rigid plane, and coaxially positioning the hinges of the door.

Preferably, said lever is comprised, in its entire length, of a member having a substantially U-shaped cross-section, thus having, at said receiving part, two side walls making it possible to maintain the foot of the user on said lever.

Preferably, said grip handle is pivotally connected to said end of said first section.

Said grip handle can in this case be connected to said end of said first section through a pin extending perpendicularly to said first section.

Preferably, said grip handle is substantially L-shaped in cross-section.

Preferably, said grip handle is adjustable in height relative to said first section.

Preferably, said grip handle has an extension opposite said flat portion, for allowing the carrying of the apparatus.

Preferably, said smooth and rigid plane includes side walls higher than front and rear walls, forming supports for the setting and removal of a door.

Preferably, said smooth and rigid plane also includes a carrying handle on one side.

DESCRIPTION OF THE PREFERRED EMBODIMENT

Figure 1:
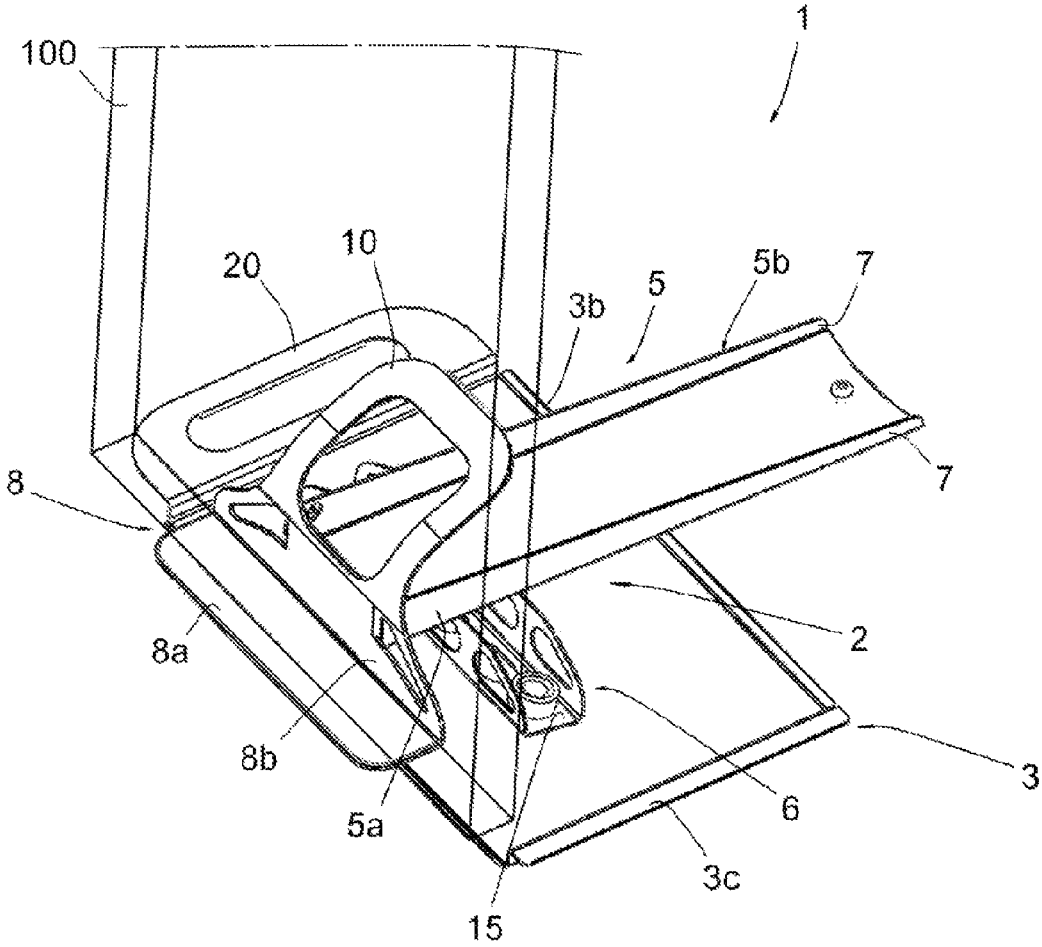
FIG. 1 is a perspective view of the assembly according to the invention, carrying a door, this door being shown as transparent.
Figure 2:
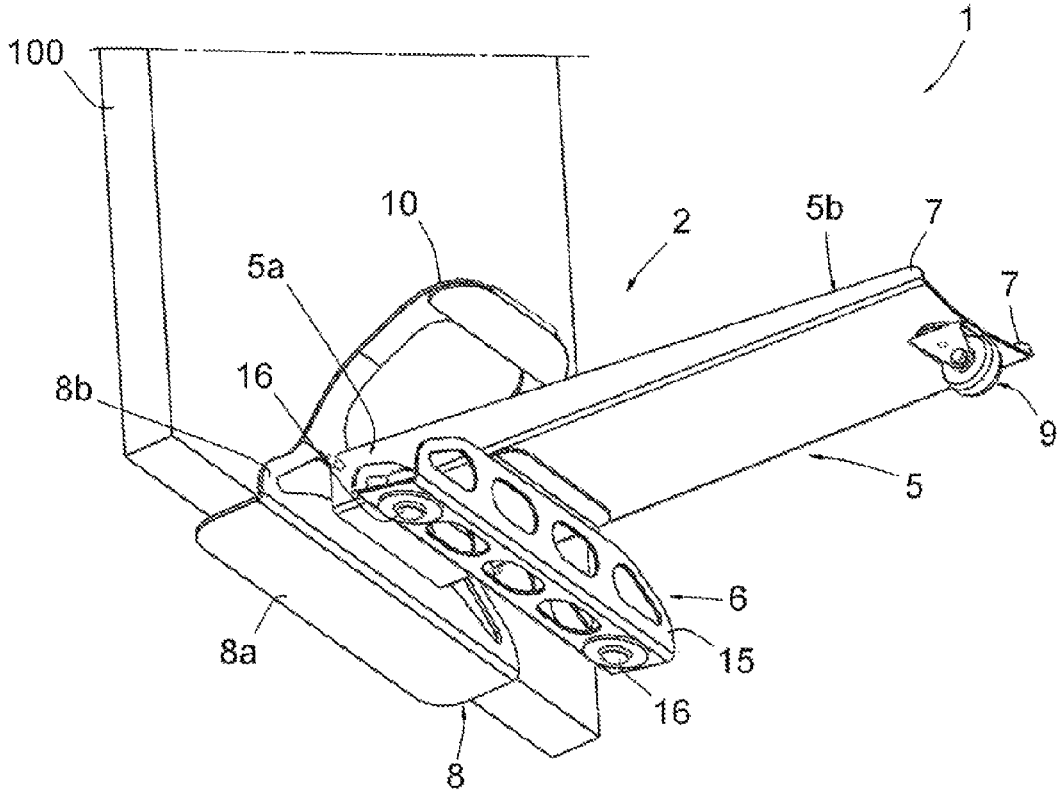
FIG. 2 is a perspective view of the assembly according to the invention, seen from below with a door on its grip handle.

As shown in FIGS. 1, 2, 4*a* and 4*b*, the assembly 1 for the setting, removal and maintenance of swing doors 100 or other similar objects comprises in combination an apparatus 2 and a smooth and rigid plane 3 on which the apparatus 2 moves.

The apparatus 2 comprises a lever 5 and a supporting element 6 for supporting the lever 5.

The lever 5 is comprised, in its entire length, of a member having a substantially U-shaped cross-section, thus having two longitudinal side walls 7. Between these walls 7, its width is sufficient to receive a foot of a user (and the shoe on this foot), so that the walls 7 make it possible to maintain the foot of the user on said lever 5.

The lever 5 is comprised of a first section 5*a* and a second section 5*b* coaxially connected, the first section 5*a* extending on one side of the supporting element 6 and the second part 5*b* extending on the other side of the supporting element 6. Said first section 5*a* is shorter than said second section.

The end of said first section 5*a* not connected to the second section 5*b* is equipped with a grip handle 8; said second section 5*b* is equipped with a pivoting roller 9 at its end not connected to said first section 5*a*.

The grip handle 8 has a substantially L-shaped cross-section, having a flat, substantially horizontal flange 8*a* and a flat, substantially vertical flange 8*b*. It also comprises an extension 10 extending from the edge of the flange 8*b* opposite said flange 8*a*, for allowing carrying the lever 5.

Said flange 8*a* is capable of sliding under the door 100 to maneuver.

Said flange 8*b* is connected to said end of said first section 5*a* through a pin extending perpendicularly to said first section, this pin forming a pivot member for pivotally connecting the grip handle 8 to the lever 5.

Said supporting element 6 comprises a body 15 forming a fulcrum for the lever 5 and, on its bottom portion, two bearing rigid balls 16 on each side of the lever 5, pivotally inserted in bearings attached to the bottom part of the body 15 and capable to roll with respect to said body 15 and on said smooth and rigid plane 3.

Figure 3A:
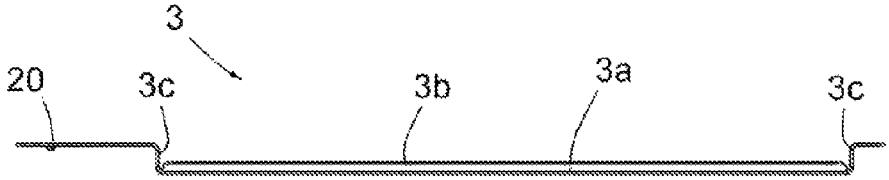
FIG. 3*a* is a side view of a smooth and rigid plane which the assembly comprises, from the front side thereof.
Figure 3B:
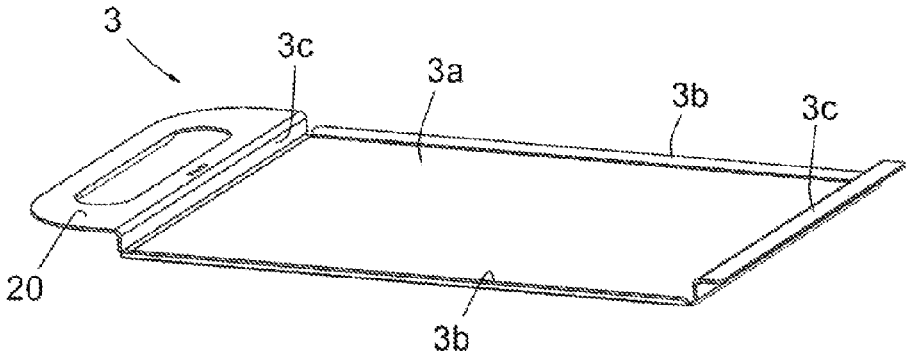
FIG. 3*b* is a perspective view of this smooth and rigid plane.
Figure 4A:
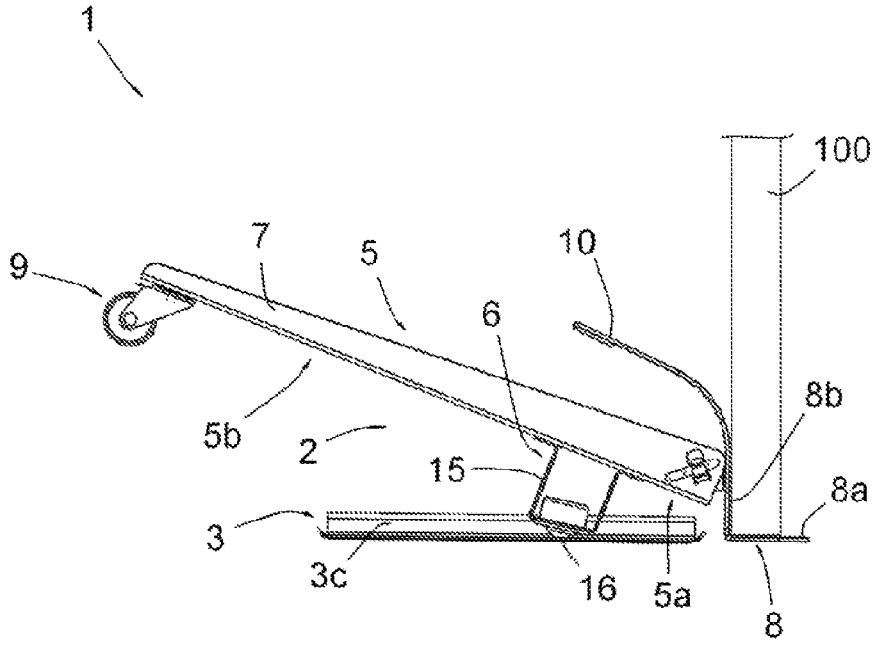
FIG. 4*a* is a side view of the assembly before raising a door.
Figure 4B:
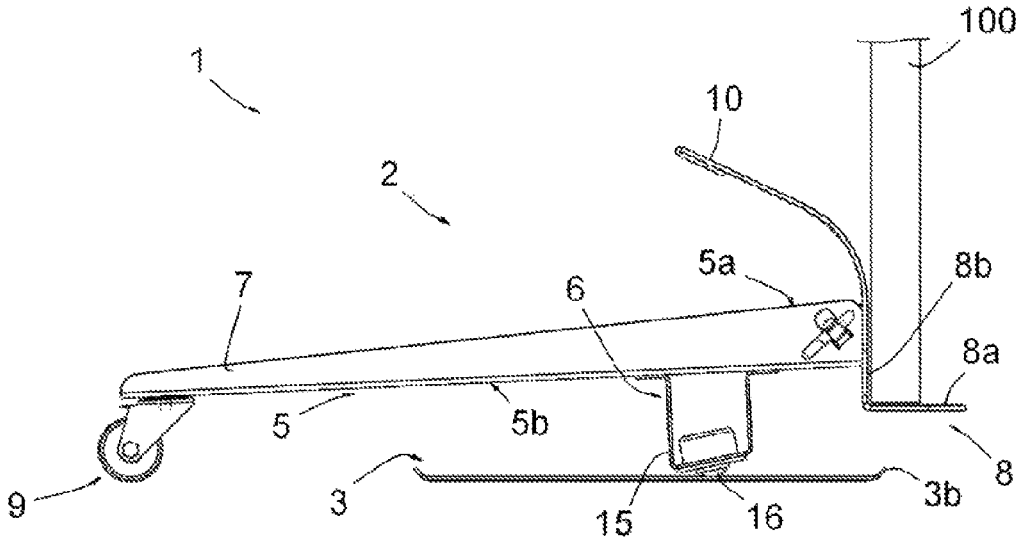
FIG. 4*b* is a side view of the apparatus assembly after raising a door.

Referring to FIGS. 3*a* and 3*b*, this smooth and rigid plane 3 comprises a flat main surface 3*a*, front and rear walls 3*b* and side walls 3*c* forming stops capable to keep the supporting element 6 on said flat main surface 3*a*. The side walls 3*c* are higher than the front and rear walls 3*b* and form supports for the setting and removal of a door 100.

The smooth and rigid plane 3 also comprises a carrying handle 20 on one side.

As shown in FIG. 1, the apparatus is driven at the vicinity of the door 100 to be raised for setting or removing the door. The horizontal flange of the grip handle 8 is then engaged under said door 100 by means of the foot acting on said second section 5*b* of the lever 5. The door is thus raised easily and effortlessly.

For setting the door 100, the door just has to be positioned in the frame at the level of the hinges; pressure on the lever 5 is then gently released to let the hinges engage coaxially. The reverse operation allows the door 100 to be removed.

In addition, any modifications to the useful details may be made to the embodiment of the apparatus, particularly in that which relates to the sections and materials intended to comprise the various elements, without necessarily going beyond the scope of the invention.

What is claimed is:

1. An assembly (1) for the setting, removal, and maintenance of swing doors (100), the assembly (1) comprising in combination;

an apparatus (2);

a smooth and rigid plane (3) on which the apparatus (2) moves;

wherein the apparatus (2) comprises a lever (5) and a supporting element (6) for supporting the lever (5); wherein said lever (5) comprises a first section (5*a*) and a second section (5*b*) coaxially connected, the first section (5*a*) extending on one side of the supporting element (6) and the second section (5*b*) extending on the other side of the supporting element (6), said first section (5*a*) being shorter than said second section (5*b*); the end of said first section (5*a*) not connected to the second section (5*b*) is equipped with a grip handle (8) having a flat portion (8*a*) capable of sliding under the door (100) to maneuver; said second section (5*b*) is equipped with a pivoting roller (9) at its end not connected to said first section (5*a*) and with a receiving part capable of receiving a foot of a user; said supporting element (6) comprises a body (15) forming a fulcrum for the lever (5) and, on its bottom portion, bearing rigid balls (16) on each side of the lever (5), capable to roll with respect to said body (15) and on said smooth and rigid plane (3);

the smooth and rigid plane (3) comprises a flat main surface (3*a*) and side walls (3*b*, 3*c*) forming stops capable to keep the supporting element (6) on said flat main surface (3*a*);

said lever (5) being capable to be activated by a foot of a user to an equilibrium position where said pivoting roller (9) bears on said smooth and rigid plane (3) or on a floor on which this plane (3) rests; in this position, the assembly (1) acts as a drive and directive force for raising the door (100), displacing the door (100) on said smooth and rigid plane (3), and coaxially positioning the hinges of the door (100).

2. The assembly according to claim 1, wherein said lever (5) has a length and comprises in its entire length a member having a substantially U-shaped cross-section, thus having, at said receiving part, two side walls (7) making it possible to maintain the foot of the user on said lever (5).

3. The assembly according to claim 1, wherein said grip handle (8) is pivotally connected to said end of said first section (5*a*).

4. The assembly according to claim 3, wherein said grip handle (8) is connected to said end of said first section (5*a*) through a pin extending perpendicularly to said first section (5*a*).

5. The assembly according to claim 1, wherein said grip handle (8) is substantially L-shaped in cross-section.

6. The assembly according to claim 1, wherein said grip handle (8) is adjustable in height relative to said first section (5*a*).

7. The assembly according to claim 1, wherein said grip handle (8) has an extension (10) opposite said flat portion (8*a*), for allowing carrying the lever (5).

8. The assembly according to claim 1, wherein said smooth and rigid plane (3) includes side walls (3*c*) higher than front and rear walls (3*b*), forming supports for the setting and removal of a door (100).

9. The assembly according to claim 1, wherein said smooth and rigid plane (3) includes a carrying handle (20) on one side.

* * * * *